US010280023B2

(12) United States Patent
Verhofstad et al.

(10) Patent No.: US 10,280,023 B2
(45) Date of Patent: May 7, 2019

(54) WEB WINDING DEVICE

(71) Applicant: Océ-Technologies B.V., Venlo (NL)

(72) Inventors: Wilhelmus J. E. G. Verhofstad, Venlo (NL); Henricus A. M. Janssen, Venlo (NL); Maurice J. C. Lemmens, Venlo (NL); Marco Kemp, Venlo (NL); Hermanus P. H. M. Van Rhee, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 269 days.

(21) Appl. No.: 15/374,569

(22) Filed: Dec. 9, 2016

(65) Prior Publication Data

US 2017/0183182 A1 Jun. 29, 2017

(30) Foreign Application Priority Data

Dec. 23, 2015 (EP) ..... 15202354

(51) Int. Cl.
*B65H 19/28* (2006.01)

(52) U.S. Cl.
CPC . *B65H 19/28* (2013.01); *B65H 2301/414222* (2013.01); *B65H 2801/15* (2013.01)

(58) Field of Classification Search
CPC ..... B65H 19/28; B65H 2801/15; B65H 2301/414222
See application file for complete search history.

(56) References Cited

U.S. PATENT DOCUMENTS 4,690,348 A * 9/1987 Watanabe ..... B65H 18/00 242/532
8,500,057 B2 * 8/2013 Åkerlund ..... B65H 19/2246 242/532.2
2002/0066376 A1 6/2002 Wallace
2006/0266871 A1 * 11/2006 Haven ..... B65H 19/28 242/532.3

FOREIGN PATENT DOCUMENTS

EP 0 182 047 A2 5/1986
JP 8-072120 A 3/1996
JP 2008-024393 A 2/2008

* cited by examiner

*Primary Examiner* — Sang K Kim
(74) *Attorney, Agent, or Firm* — Birch, Stewart, Kolasch & Birch, LLP

(57) ABSTRACT

The invention provides a web winding device for attaching a leading edge of a web to a take-up roller positioned at an end of a transport path. A guide device is rotatable around the roller axis of the take-up roller from a first to a second angular position. The first angular position is positioned adjacent the end of the transport path and the second angular position is positioned in a space between the transport path and the take-up roller. The guide device is arranged for:

at the first angular position, pushing the leading edge of the web against the take-up roller;

during rotation, holding the leading edge in pushing engagement with the take-up roller; and at the second angular position, guiding the leading edge between the web on the transport path and the take-up roller for attaching the leading edge to the take-up roller.

15 Claims, 6 Drawing Sheets

WEB WINDING DEVICE

BACKGROUND OF THE INVENTION

1. Field of the Invention

The invention relates to a web winding device for attaching a leading edge of a web output by a printing system to a take-up roller 2. Description of Background Art In web-based printing, the printed web is spooled onto a medium roll for easy storage and transport. It is known to attach the web to the roll by means of an adhesive, which may be applied to the web or the roll. Generally devices are known for automatically attaching the leading edge without the need for manual intervention. Such a device for example comprises a guide for directing the leading around the roll and an attachment device for securing the leading edge to the roll. Drawback of the known web winding devices is their unreliability. The automatic attachment occasionally fails in known devices, especially when different media types and sizes are applied. A further drawback of the known devices is that these are often structurally complex.

SUMMARY OF THE INVENTION

It is an object of the invention to provide an improved web winding device for reliably attaching a leading edge of a web to a take-up roller without the need for manual intervention by an operator.

In accordance with the present invention, a web winding device according to claim 1 and a method according to claim 12 are provided.

The present invention provides a web winding device for attaching a leading edge of a web output by a printing system to a take-up roller. The web winding device comprises a transport path for a web and a take-up roller rotatable around a roller axis positioned at the end of the transport path. A guide device is provided, which guide device is rotatable with respect to the roller axis from a first angular position to a second angular position. The guide device may rotate over the same roller axis as the take-up roller over a predefined angular range determined by the first and second angular positions.

The first angular position is positioned adjacent the end of the transport path, preferably (directly) downstream of and near a point of contact between the web and the take-up roller. Said point of contact defines the end of the transport path from where the web is guided further over the take-up roller. The second angular position is positioned in a space between the transport path and the take-up roller. A nook or corner comprising the second angular position is formed between a bottom surface of the web and the outer surface of the take-up roller, where the web is spooled onto the roller at said point of contact.

The guide device according to the present invention is arranged for, when at the first angular position, pushing a leading edge of the web against the take-up roller. The guide device is further arranged for, during rotation, holding the leading edge in pushing engagement with the take-up roller. The guide device is further arranged for, when at the second angular position, guiding the leading edge between the web on the transport path and the take-up roller for attaching the leading edge to the take-up roller. The guide device performs the functions of engaging and pushing the leading edge to the take-up roller, holding the leading edge securely against the take-up roller during rotation, and tucking the leading edge in between the bottom surface of the web and take-up roller. Thereby, since the guide device performs said functions, no additional devices are required and the construction of the web winding device is simplified. Further, the reliability of the web winding device is improved, since from the initial moment of engagement to the moment of tucking in the leading edge, the leading edge is held onto the take-up roller by the same guide device. Since the leading edge is not transferred between different devices, the risk of the leading edge disengaging from the take-up roller or being becoming misaligned with respect to the take-up roller is reduced. Thereby, the object of the present invention has been achieved.

More specific optional features of the invention are indicated in the dependent claims.

In an embodiment, the first angular position is positioned on one side of a central plane substantially perpendicular to a plane of the transport path which central plane extends through the roller axis, and wherein the second angular position is positioned on a second side of the central plane. The first and second angular positions are angularly offset with respect to one another by an offset angle, which in an example may be at least 180°. An initial point of contact between the web and the take-up roller is preferably positioned in the central plane. The first angular position is preferably positioned near said initial point of contact to engage the leading edge after it leaves the transport path for engaging the leading edge without the risk of misalignment.

In a preferred embodiment, the web winding device further comprises an angular actuator device for rotating the guide device synchronously with respect to the take-up roller. By keeping the angular velocity of the leading edge, guide device and take-up roller similar, preferably identical, misalignment of and/or damage to the web is prevented since no additional tension forces are applied to the web.

In another embodiment, the angular actuator device comprises a first pivoting arm pivotable with respect to the roller axis, on which first pivoting arm the guide device is mounted. Said first pivoting arm is preferably positioned to the sides of the take-up roller and/or web and provides a simple and reliable motion of the guide device.

In an embodiment, the guide device, during use, extends parallel to the roller axis over substantially the width of the web, which preferably corresponds to the width of the transport path and/or the width of the take-up roller. Thereby, the guide device is arranged for engaging the leading edge over its substantially full width for securely holding the leading edge to the take-up roller. Further advantage of said width of the guide device is that web winding device according to the present invention is arranged for handling a wide variety of media, specifically for handling various media widths. The guide device preferably engages a medium, regardless of its width, along the full width of its leading edge region.

In a preferred embodiment, the guide device further comprises two guide elements, such as guide rollers. These guide elements, when in pushing engagement with the leading edge, are angularly spaced apart from one another with respect to the roller axis. While pushing against the leading edge, the guide elements are angularly offset with respect to one another by a small angle, e.g. 1-30°. The leading edge is thereby engaged at two different angular positions resulting in a secure holding of the leading edge, preventing it from disengaging or mis-orientating with respect to the take-up roller. Alternatively, the rear guide element by itself may already provide sufficient force for securely holding the web onto the take-up roller during rotation. Further, the front guide element or roller, when viewed in the angular rotation direction of the take-up roller, may then be configured for tucking the leading edge in between the web and the take-up roller, for example, by reducing the size or diameter of the front guide element. The size of the rear guide element or roller is preferably relatively large to provide a secure holding of the web on the take-up roller.

In another embodiment, the rear guide element may be a pressure roller extending in the direction of the roller axis or a plurality of pressure rollers arranged besides one another in the direction of the roller axis R. Thereby, the leading edge region of the medium is reliably held against the medium. The rear guide element is preferably connected to a resilient element or base body for providing a force for pressing guide device, specifically the rear guide element, onto the web and the take-up roller. Said base body may be resilient or may comprise an actuator, a spring or a leaf spring for exerting a pressing force on the guide device. The front guide element may be arranged for guiding the leading edge into the corner between the medium and the take-up roller due to its reduced dimensions with respect to the rear guide element. The resilient base body allows media of various thicknesses to be applied in the web winding system according to the present invention without additional modification. The resilient base body may for example move or curve away from the take-up roller when thicker media are applied for example due to its resilient configuration. Preferably, the base body is pretensioned during use, such that the guide device exerts sufficient holding force on the web.

In a further embodiment, the web winding device further comprises an engagement actuator device for moving the guide device from a remote position spaced apart from the take-up roll to the first angular position for pushing the leading edge against the take-up roller. Therein the guide device may be brought into pushing engagement with the leading edge extending over the take-up roller. This allows the leading edge to initially be transported over the take-up roller without hindrance of the guide device, which guide device is then moved against the leading edge to push the leading edge to the take-up roller. Preferably, the engagement actuator device comprises a second pivoting arm pivotable with respect to a pivoting axis for positioning the first pivoting arm with respect to the roller axis.

In another embodiment, the web winding device further comprises a moveable pressing device positioned near the second angular position, which pressing device is arranged for pushing the guide device at the second angular position against the web on the take-up roller. Thereto, the pressing device is moveable towards the take-up roller and further preferably moveable away from the take-up roller for releasing the guide device from the web on the take-up roller. This allows the guide device to securely and reliably tuck the leading edge into the corner or nook between the bottom surface of the web and the take-up roller. The pressing device applies a force directed towards the take-up roller, specifically towards the roller axis, onto the guide device, specifically onto the front guide element, for securing the guide device at the second angular position. This results in a reliable attachment of the leading edge to the take-up roller.

In a further embodiment, the web winding device further comprises a pinch roller moveable between a distant position and a pinch position adjacent the take-up roller, wherein the pinch roller and the take-up roller are arranged for holding the web between them. The pinch roller exerts a force on the web directed towards the roller axis, such that the web becomes frictionally engaged by the take-up roller. This allows the web to be moved along with the take-up roller. The pinch roller may further prevent the web from misaligning itself with respect to the take-up roller.

In a preferred embodiment, the web winding device further comprises a controller arranged for actuating the web winding device, which controller comprises a sensor device for detecting the leading edge of the web. This allows the leading edge to be secured to the take-up roller without manual interference from an operator. Upon detection of the leading edge, the guide device is moved to the first angular position, rotates to the second angular position, where the leading edge is moved into the corner between the web and the take-up roller. Additionally, a sensor may be provided for detecting the leading edge near the second angular position, such the controller may based upon input from said sensor actuate the pressing member. Alternative, the controller may comprise data related to media characteristics and web winding device properties to determine a proper timing for actuating the guide device, and/or the pressing member.

In another aspect, the invention provides a printing system comprising a web winding device according to the present invention. The printing system outputs printed web on a transport path at the end of which the web winding device is positioned. Operator time for such a printing system is reduced, since the leading edge may be attached to the take-up roller by means of the guide device according to the present invention.

In another aspect, the present invention provides a method for winding a web output along a transport path of a printing system on a take-up roller, which take-up roller is rotatable with respect to a roller axis. The method comprises the steps of:

- transporting a leading edge of a web from the transport path over a take-up roller;
- positioning the guide device in a first angular position with respect to the roller axis, which first angular position is positioned adjacent the transport path and in which first angular position the guide device pushes the leading edge against the take-up roller,
- rotating the guide device to a second angular position with respect to the roller axis, which second angular is positioned in a space between the transport path and the take-up roller;
- holding the guide device in pushing engagement with the leading edge as the guide device rotates from the first angular position to the second angular position;
- positioning the guide device in the second angular position to guide the leading edge between the web and the take-up roller. In the second angular position the guide device is positioned to guide the leading edge between the web and the take-up roller.

Thereby, the leading edge is attached to the take-up roller without the need for manual intervention or adhesives.

The guide device engages the leading edge of the web output by a printing system, when the leading edge extends over the take-up roller. The guide device pushes the leading edge against the outer surface of the take-up roller for secure attachment thereto. The guide device then holds the leading edge against the take-up roller by pushing the leading edge against the take-up roller, while the guide device is rotated around the roller axis. The leading edge (and preferably the take-up roller) rotates along with the guide device to the space or nook between the web on the transport path and the take-up roller. The guide device, which is then static at the second angular position, tucks the leading edge into the corner between the web and the take-up roller, which take-up roller and leading edge continue to rotate. The leading edge is held in place between the take-up roller during a following revolution of the web onto the take-up roller by friction. When said friction is sufficiently high for secure attachment, the guide device may be released from the take-up roller and returned to its initial position.

In an embodiment, the step of positioning the guide device further comprises moving the guide device from a remote position spaced apart from the take-up roller to the first angular position to push the leading edge against the take-up roller. The guide device thus engages the web. In another embodiment, the method according to the present invention further comprises the steps of guiding the leading edge between the web on the transport path and the take-up roller, and releasing the guide device from the web, for example when a level of said friction is sufficiently high to securely hold the leading edge onto the take-up roller. In an even further embodiment, the step of positioning the guide device in the second angular position further comprises the step of pushing the guide device at the second angular position against the web on the take-up roller. This results in a more reliable tucking in of the leading edge.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE PREFERRED EMBODIMENTS

Figure 1:
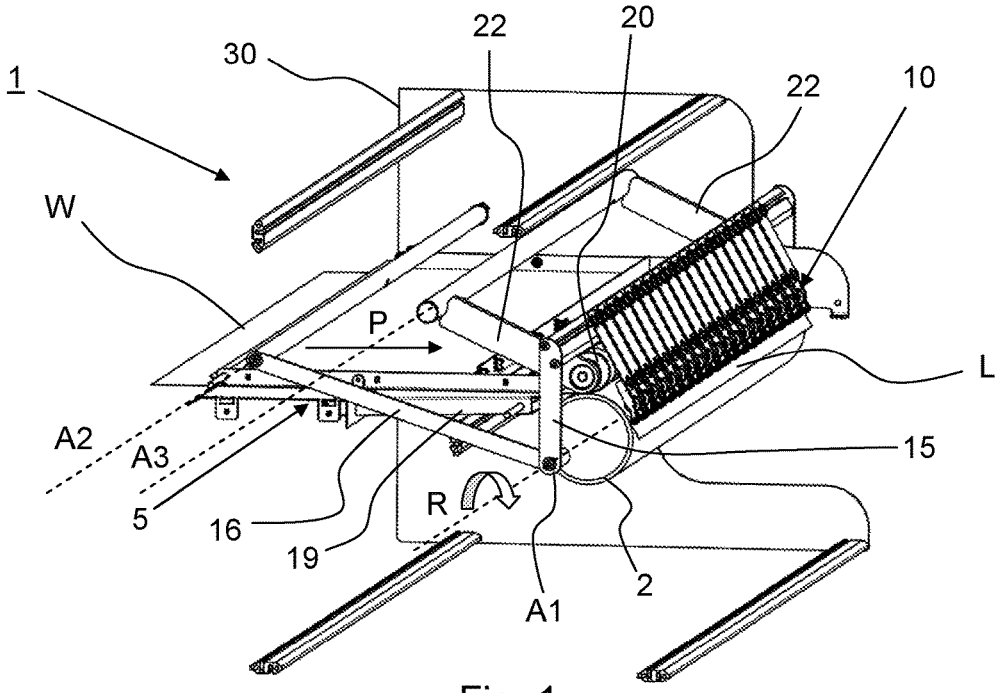
FIG. 1 is a schematic perspective view of a web winding device according to the present invention.

The present invention will now be described with reference to the accompanying drawings, wherein the same reference numerals have been used to identify the same or similar elements throughout the several views.

A web winding device 1 according to the present invention is illustrated in FIG. 1. A web W is output from a printing system (not shown) and transported over transport path P to and over the take-up roller 2. An engagement actuator device comprising a second pivoting arm 16 is configured to bring a guide device 10 into a first angular position AP1, wherein the guide device 10 pushes a leading edge L of the web W onto the outer surface of the take-up roller 2. The guide device 10 is rotable around the same roller axis R as the take-up roller 2. An angular actuator device is arranged for rotating the guide device 10, and thereby the leading edge L, synchronously with the take-up roller R by means of a first pivoting arm 15, pivotably connected to the second pivoting arm 16 at the first axis A1. The guide device 10 may thus rotate towards a second angular position AP2, wherein a pressing device 19 pushes the guide device 10 towards the take-up roller 2 for guiding the leading edge L between the web W and the take-up roller 2. The leading edge L thus becomes attached to the take-up roller 2.

In FIG. 1, the web W is transported along a transport path P formed by a transport or transporter unit 5, for example rollers or a static guide surface, positioned downstream from a printing system (not shown). Driving rollers (not shown) upstream of the take-up roller 2 may move the web W along the planar, preferably horizontal, transport path P and over the take-up roller 2. The end of the transport path P is positioned adjacent the take-up roller 2. The transport path P extends preferably tangentially to the outer surface of the take-up roller 2. Above the take-up roller 2 a pinch roller 20 is provided, which pinch roller is pivotable around a third axis A3 between a distant position positioned at a distance from the take-up roller 2 and a pinch position. The pinch roller 20 and the take-up roller 2 are arranged for forming a transport pinch 2, 20 for the web W. The pinch roller 20 is rotably mounted on a third pivoting arm 22. An actuator, such as an electric motor, may be provided for moving the pinch roller 20 between the remote and pinch positions. The pinch roller 20 pushes the web W against the take-up roller 2, such that it experiences sufficient friction to be transported by the take-up roller 2. An actuator or drive motor may be provided for rotating the take-up roller 2. Thereby, a pulling force is applied to the web W for transporting the web W along the transport path P. It will be appreciated that the first pivoting arm 15, the second pivoting arm 16, and/or the third pivoting arm 22 may be provided on either side of the transport path P (or the web W) in pairs, which pairs may be connected to another for strengthening the construction of the web winding device 1.

Figure 2:
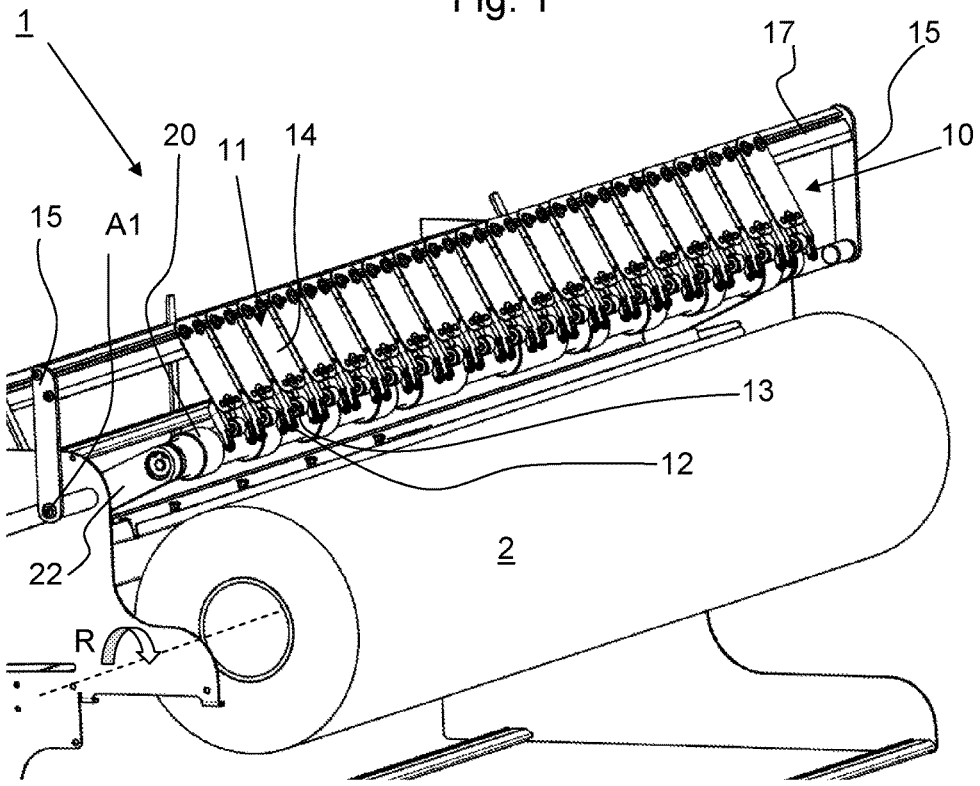
FIG. 2 is a schematic perspective view of a web winding device according to the present invention with the guide device in the remote position.

FIG. 2 shows the guide device 10 in the remote position. The guide device 10 extends axially along the take-up roller 2 over substantially the width of the web W. The guide device 10 comprises a plurality of guide units 11 positioned along the axial direction (which is parallel to the roller axis R). The guide units 11 are mounted on a beam element 17 connecting the pair of first pivoting arms 15 on either side of the take-up roller 2. The beam element 17 may be a bar or comprise a profile. Each guide unit 11 comprises a front guide element 12 and a rear guide element 13, which in FIG. 2 are configured as one or more front guide rollers 12 and at least one rear guide roller 13. When the guide elements 12, 13 push the web W against the take-up roller 2, they engage the web W at two angularly offset positions. Thereby the web W is securely held by the guide device 10, reducing the risk of the web W disengaging from the take-up roller 2 or shifting in its position on the take-up roller 2. In FIG. 2, each guide unit 11 comprises two front guide rollers 12 position angularly forward and to either side of the rear guide roller 13. The front guide rollers 12 are connected to a base body 14 (base plate 14 in FIG. 2) mounted on the beam element 17 by means of an angled or curved arm, which arm extend angularly beyond the rear guide roller 13. The front guide roller 12 in smaller in diameter than the rear guide roller 13, which enables the front guide roller 12 to tuck the leading edge L in between the web W and the take-up roller 2 at the second angular position AP2.

The guide device 10 in FIG. 1 is positioned at the first angular position AP1. The engagement actuator device may move the guide device from the first angular position AP1 to a remote position spaced apart from the take-up roller 2, as shown in FIG. 2. Thereto, the guide device 10 is provided on a second pivoting arm 16 pivotable around a second axis A2. The second pivoting arm 16 is configured to align a first axis A1 around which the guide device 10 is pivotable with respect to the roller axis R, preferably such that the first axis A1 coincides with the roller axis R. Thereby, the first axis A1 becomes similar to or overlaps with the roller axis 1, allowing the guide device 10 to rotate synchronously with the take-up roller 2.

The workings of the web winding device 1 according to the present invention will be described in FIGS. 3 to 11, which illustrate various steps of the method according to the present invention.

Figure 3:
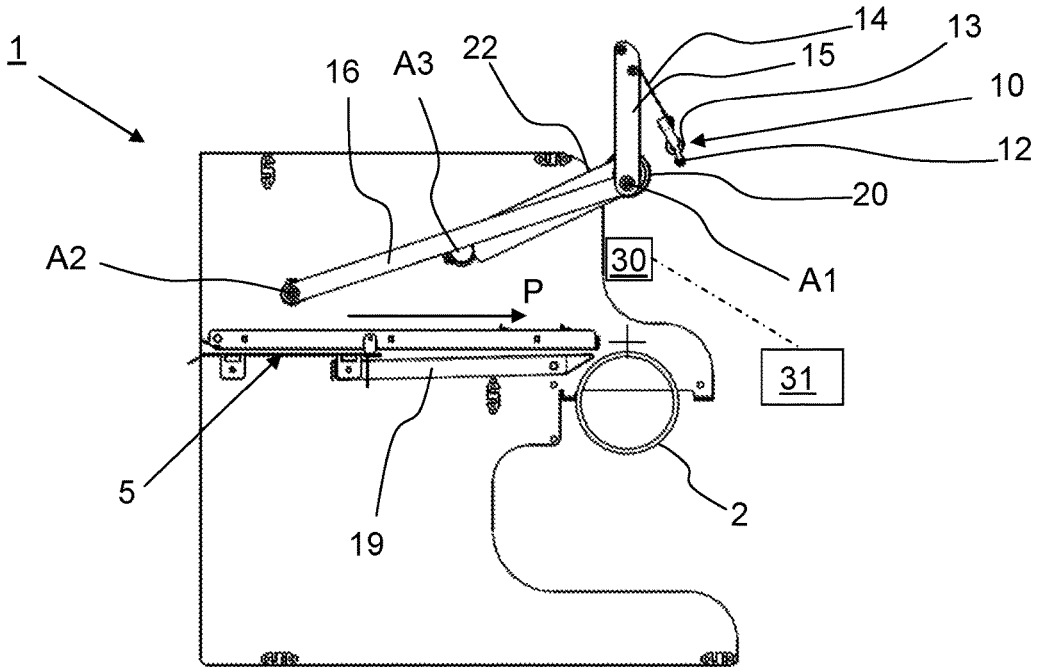
FIG. 3 is a schematic side view of a web winding device according to the present invention with the guide device in the remote position.

FIG. 3 depicts a side view of the web winding device 1, wherein a web W is output by the printing system and transported over the transporter unit 5 towards the take-up roller 2. In FIG. 3, the guide device 10 is in the remote position, at a distance from the take-up roller 2. The pinch roller 8 is likewise spaced apart from the take-up roller 2 to allow the web W to proceed freely over the take-up roller 2. As the web W is being pushed further along the transport path P to the situation in FIG. 4, where the leading edge L extends over the top side of the take-up roller 2 due to a stiffness of the web W. A sensor device 30 may be provided for detecting a leading edge L of the web W. A controller 31 may then based upon a signal from the sensor device 30 perform the steps of the method according to the present invention. Specifically, the controller 31 may arranged for actuating the take-up roller 2, guide device 10, the pinch roller 20, the pressing device 19, the first pivoting arm 15, the second pivoting arm 16, and/or the third pivoting arm 22 based on input from the sensor device 30 and/or data related to the properties of the web medium W and the web winding device 1, such as web W thickness and a diameter of the take-up roller 2. Thereby, the attachment of a leading edge L may be automated requiring little to none operator time. Said steps i to vi according to the present invention are described with respect to their accompanying figures.

Figure 4:
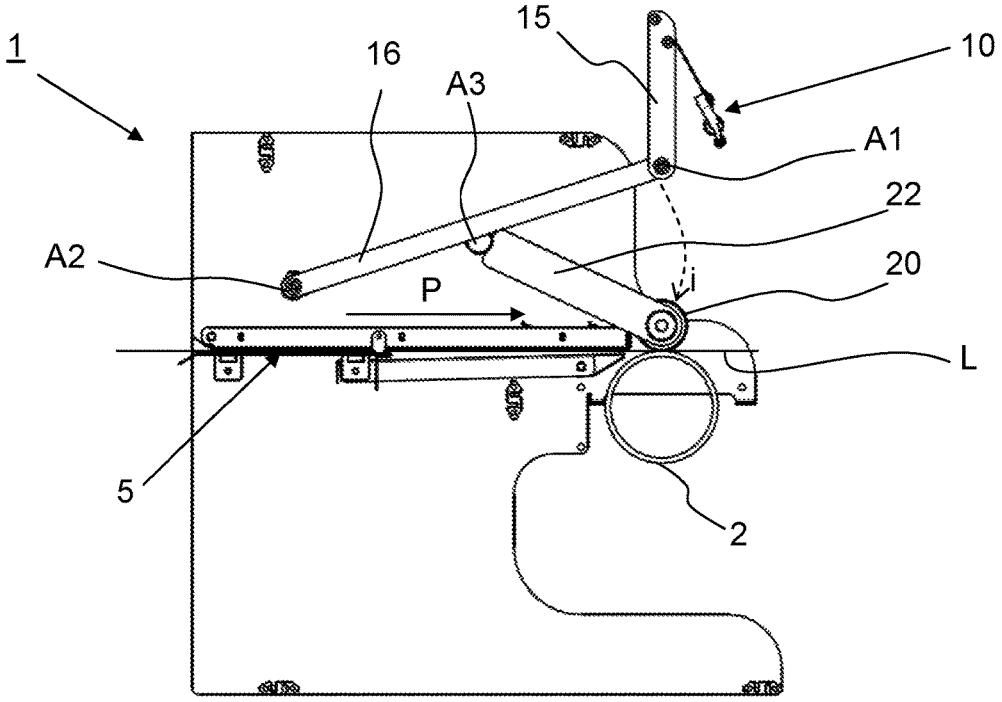
FIG. 4 is a schematic side view of a web winding device according to the present invention with the pinch roller in the pinch position.

FIG. 4 shows the step i of moving the pinch roller 20 for engaging the web W, preferably at the top side of the take-up roller 2. The pinch roller 20 is rotably mounted at the ends of a pair of third pivoting arms 22, which are pivotable around the third axis A3. An actuator (not shown) is provided for pivoting the pinch roller 20 and holding the pinch roller 20 in pushing or pressing engagement with the web W against the take-up roller 2. This allows the take-up roller 2 to frictionally engage the bottom surface of the leading edge L (and consecutively of the web W), thereby pulling the web W along with the take-up roller 2.

Figure 5:
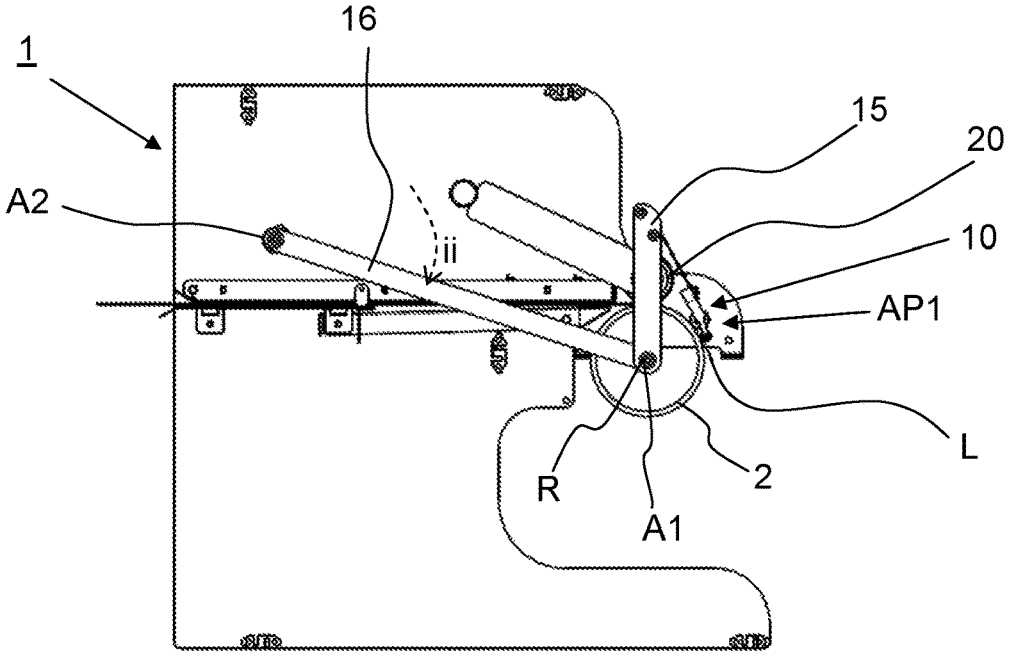
FIG. 5 is a schematic side view of a web winding device according to the present invention with the guide device in the first angular position.

Subsequently, the guide device 10 is moved into the first angular position AP1, as shown in step ii illustrated in FIG. 5. It will be appreciated that the illustrated sequence of steps i and ii may be switched. The guide device 10 is mounted on the second pivoting arm 16, which second pivoting arm 16 may pivot around the second axis A2, such that the guide device 10 is positioned to rotate around the roller axis R, e.g. by aligning or superpositioning the first axis A1 with the roller axis R. In FIG. 5, the first pivoting arm 15 is pivotably connected to an end of the second pivoting arm 16 opposite the second axis A2. The first and second pivoting arms 15, 16 are positioned to the side of the transport path P, so as not to obstruct transport of the web W. The guide device 10 may be resiliently connected to the first pivoting arm 15. This allows the web winding device 1 to process webs W of various thicknesses without modification of the web winding device 1. Due to the resilient connection between the guide device 10 and the first pivoting arm 15, e.g. by means of a resilient base body 14 acting as a spring or leaf spring, a constant pressing force is provided for pressing the guide device 10 towards the take-up roller 2.

In step ii, the guide device 10 engages and pushes the leading edge L extending over the take-up roller 2 against the circumference of the take-roller 2. The leading edge L is thus bent against the take-up roller 2 between the pinch roller 20 and the guide device 10. The pinch roller 20 may hold the web W, while the guide device 10 pulls the leading edge L taut against the take-up roller 2 to prevent wrinkling. Next, the guide device 10 commences its rotation from the first angular position AP1 positioned directly downstream of the pinch roller 20 to the second angular position AP2.

Figure 6:
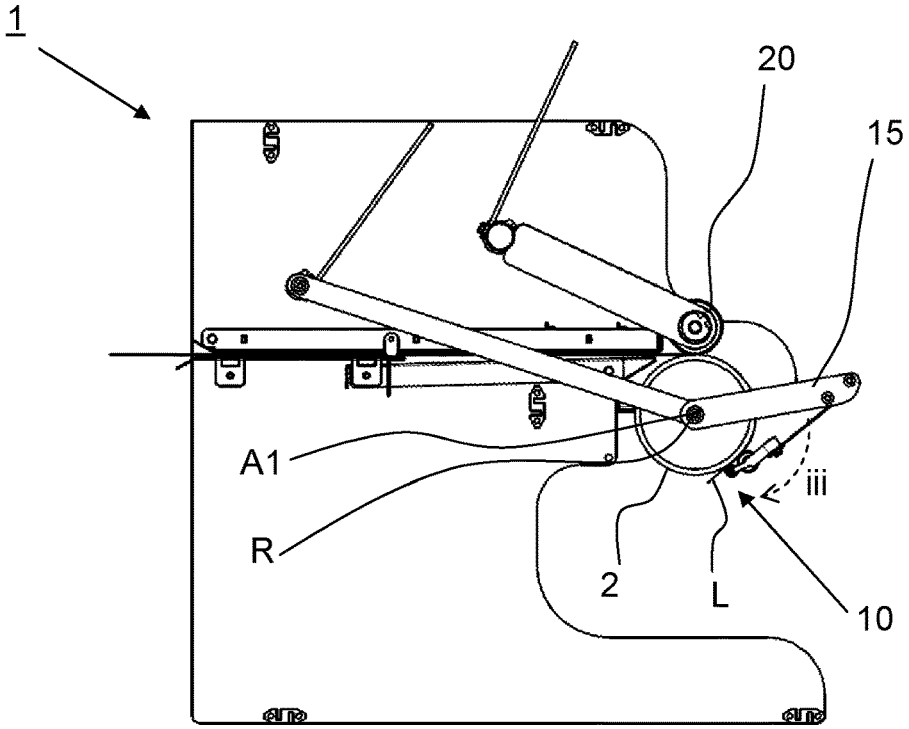
FIG. 6 is a schematic side view of a web winding device according to the present invention with the guide device being rotated around the take-up roller.
Figure 7:
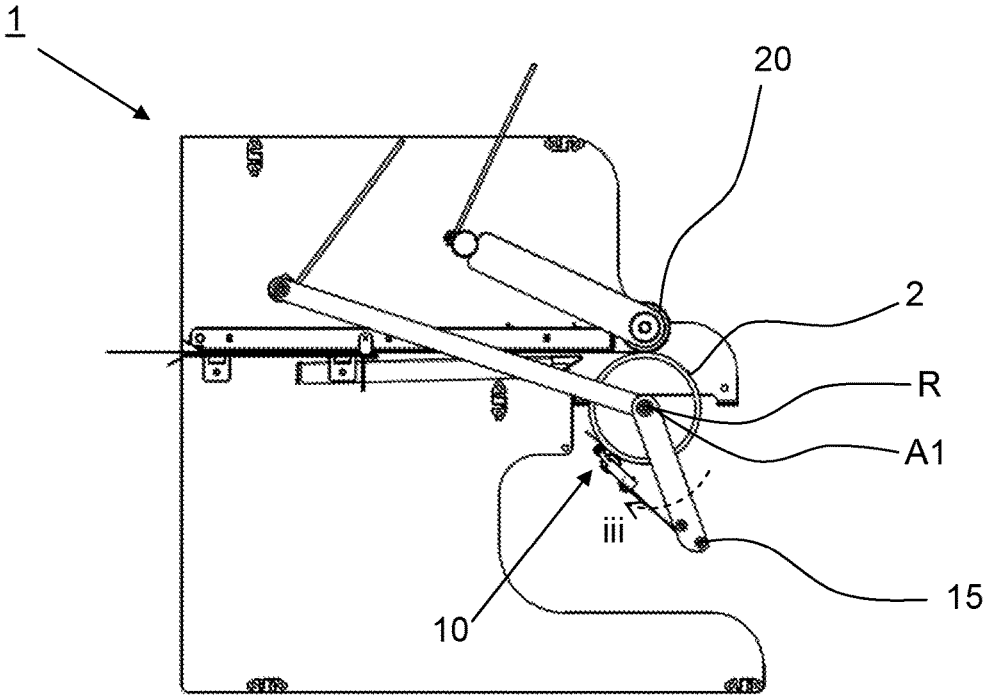
FIG. 7 is a schematic side view of a web winding device according to the present invention with the guide device being rotated further around the take-up roller.
Figure 8:
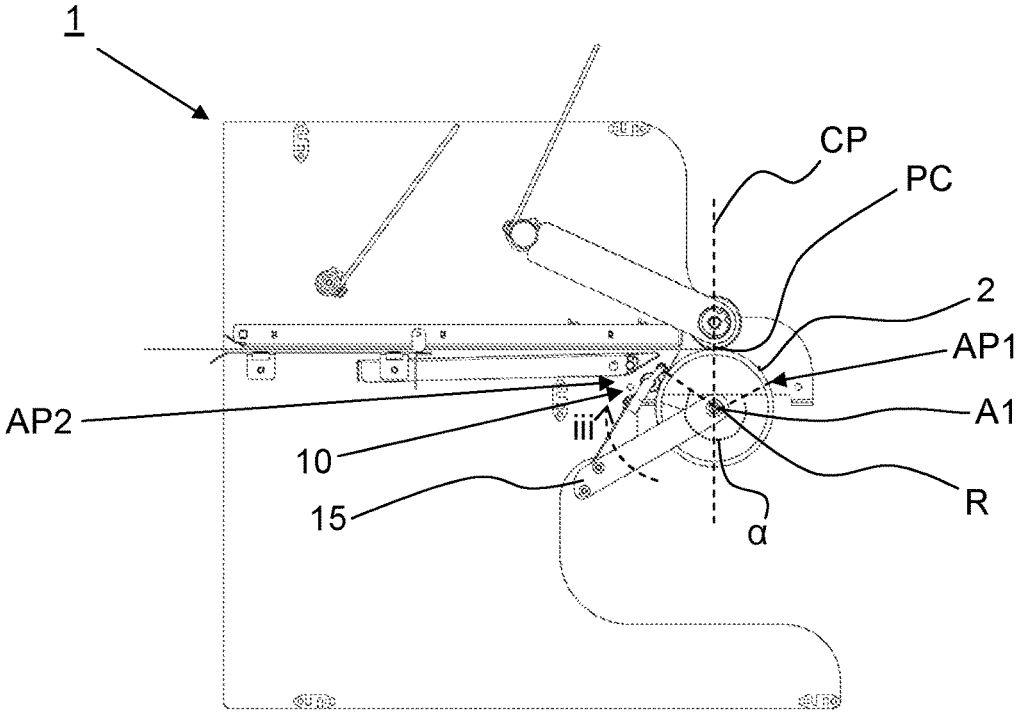
FIG. 8 is a schematic side view of a web winding device according to the present invention with the guide in the second angular position.

Step iii wherein the rotational motion of the guide device 10 between the angular positions AP1, AP2 is performed as consecutively shown in FIGS. 6 to 8. While pushing the leading edge L towards and against the roller axis R, the guide device 10 rotates synchronously with the leading edge L and the take-up roller 2 around the roller axis R. An angular actuator device may be provided for driving said rotation, while the axially inward force of the guide device 10 on the leading edge L may be provided by said angular actuator device or a further actuator such as a spring device. The electric motor for the take-up roller 2 may be used for driving the guide device 10. The guide device 10 is positioned angularly forward with respect to the first pivoting arm 15 by mounting the guide device 10, specifically the longitudinal base body 14, at an angle to the first pivoting arm 15. The guide device 10 may be resiliently provided on the first pivoting arm 15 for pushing or pressing onto the leading edge L, e.g. by means of a resilient base body 14. The base body 14 may for example be formed as a leaf spring. The guide device 10 rotates from the angular position AP2 to the angular position AP2 over an increasing angle, ~30-45° degrees between FIGS. 5 and 6, ~75-90° between FIGS. 6 and 7, and ~80-100° between FIGS. 7 and 8. The guide device 10 thus rotates over the majority of a turn over a rotation angle $\alpha$ of at least 180°, preferably a rotation angle $\alpha$ between 180 and 330°. After said rotation $\alpha$, the guide device 10 is positioned at the second angular position AP2, which in FIG. 8 is positioned on the opposite side of the a central plane CP as the first angular position AP1. The central plane CP extends through the roller axis R and an initial point of contact PC between the web W and the take-up roller 2. The end of the transport path P corresponds to the initial point of contact PC, where the web W contacts the take-up roller 2. Said initial point of contact PC is preferably directly upstream of the first angular position AP1. In FIG. 8, the point of contact PC is defined by the pinch roller 20 in contact with the top side of the take-up roller 2.

Figure 9:
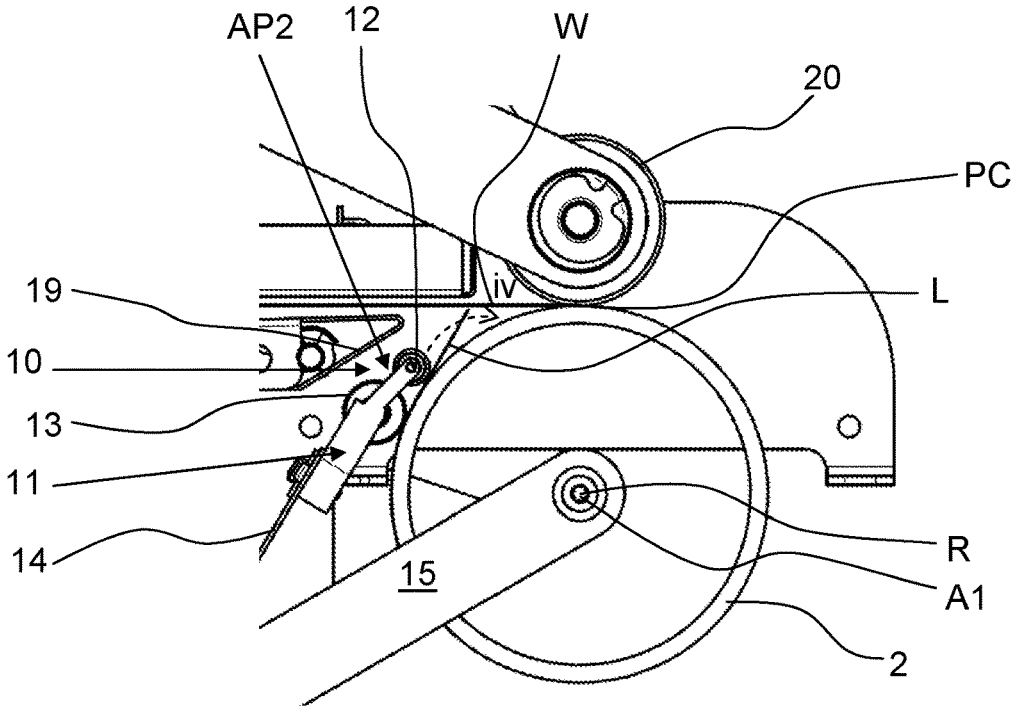
FIG. 9 is an enlarged schematic side view of the web winding device in FIG. 8.
Figure 10:
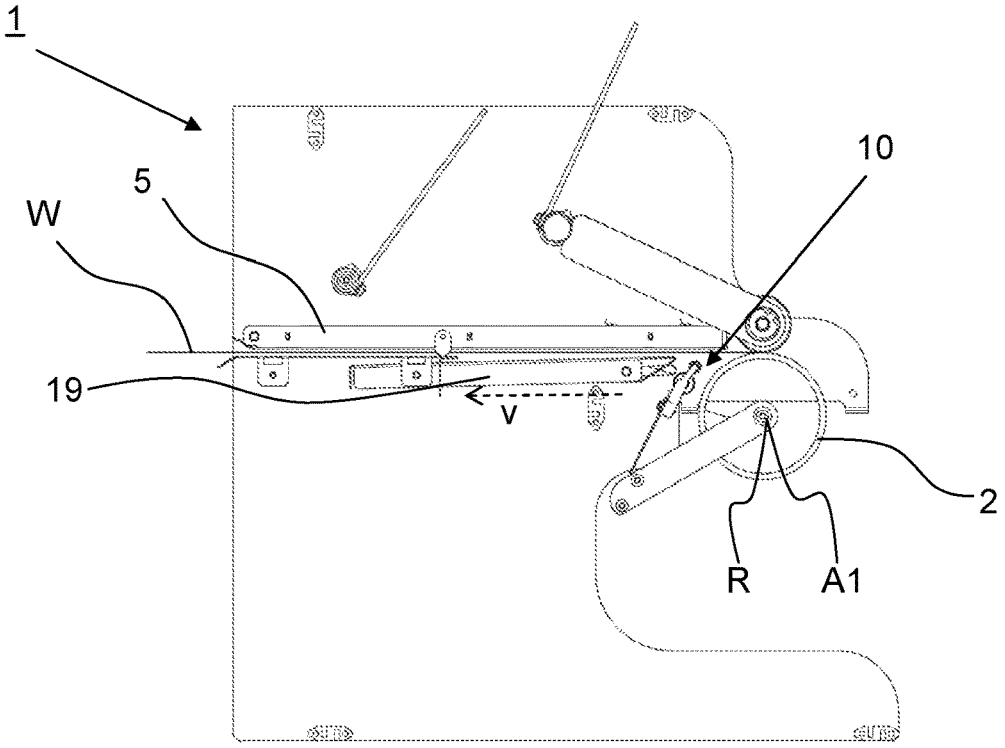
FIG. 10 is a schematic side view of a web winding device according to the present invention with the guidance device positioned away from the guide device in the second angular position.
Figure 11:
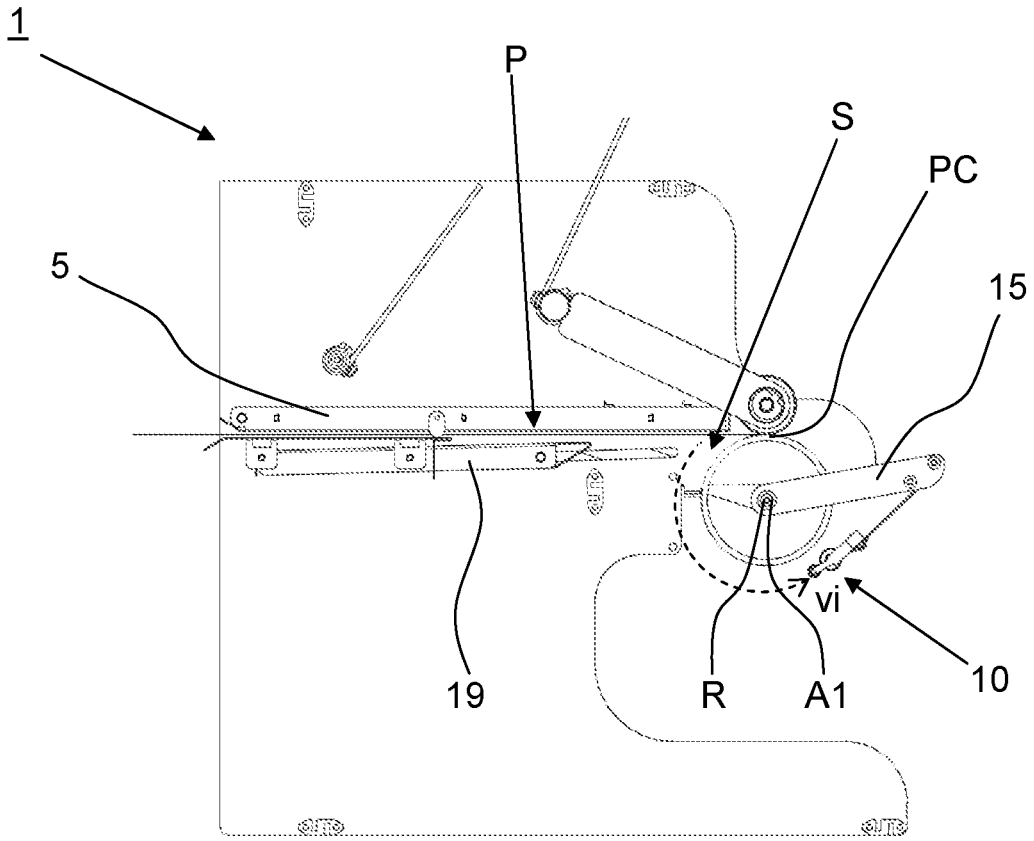
FIG. 11 is a schematic side view of a web winding device according to the present invention with the guide device being rotated to the first angular position.

FIG. 9 shows an enlarged view of the guide device 10 at the second angular position AP2. The guide device 10 then is positioned between the bottom surface of the web W, and the outer surface of the take-up roller 2 (FIG. 11 shows the space S wherein one corner of the substantially triangular region S is formed by the transport path P and the take-up roller 2 intersecting at the point of contact PC). In step iv, the guide device 10 directs the leading edge L between the web W and the take-up roller 2 for attaching the web W to the take-up roller 2. Since the front guide element 12 is relatively small is may be positioned sufficiently near the point of contact PC to reliably tuck the leading edge L into the corner between the web W and the take-up roller 2. There, the guide device 10, specifically the front guide element 12 is in contact with the pressing device 19, which pushes the guide device 10 against the take-up roller 2. Thus, the front guide element 12 directs the leading edge L between the web W and the take-up roller 2. The pressing device 19 is preferably in position when the guide device 10 is positioned at the second angular positioned AP2, but may alternatively be pushed against the guide device 10 after the guide device 10 has arrived at the second angular position AP2. FIG. 9 illustrates the V-shaped configuration of the guide device 10 and the first pivoting arm 15, which allows the front guide element 12 to tuck the leading edge L between the web W and the take-up roller 2. FIG. 9 further shows side view of the guide unit 11. The front and rear guide rollers 12, 13 rotatably mounted on the base body 14 are arranged for pressing and holding the web W against the take-up roller 2. The rear guide roller 13 comprises a larger diameter compared to the front guide roller 12 for a secure holding of the web W between the rear guide roller 13 and the take-up roller 2. The relatively smaller diameter of the front guide roller 12 allows it to accurately direct the leading edge L into the corner formed by web W and the take-up roller 2. This allows the web W to be attached to the take-up roller 2 by friction without requiring adhesives. The guide units 11, and thereby the front and rear guide elements 12, 13 extend over the width of the transport path P in the direction of the roller axis R. A single guide unit 11 with a front and a rear guide element 12, 13 extending along said width may also be applied within the scope of the present invention. By extending over said width, the web winding device 1 is arranged for winding web W or media of various widths without modification to the web winding device 1, resulting in a versatile and widely applicable device.

When the leading edge L is positioned between the web W and the take-up roller 2 at the point of contact PC, the leading edge L becomes frictionally engaged and is transported with the take-up roller 2. The guide device 10 and/or the pressing device 19 may remain at the second angular position AP2 for one or more revolutions (e.g. as predefined by the data on the controller 31) until a sufficiently high level of friction has been achieved between the web W and the take-up roller 2 for holding the web W in place. In step v, the pressing device is 19 moved away from the take-up roller 2, such that the guide device 10 is released from the web W wound onto the take-up roller 2. The pressing device 19 is movable substantially parallel to the transport path P. Said web W then remains wrapped around the take-up roller 2 due to friction. The guide device 10 may then rotated back to the first angular position AP1, as shown in step vi in FIG. 11. The web winding device 1 may then be returned to its original configuration, as shown in FIG. 1 for engaging a new leading edge L. To this end, the web winding device 1 may comprise a cutter device on or upstream of the transporter unit 5. Furthermore, the transporter device 5 may comprise a buffer region, for example by means of a pivotable panel which directs the web into buffer zone. A clamping device may then be provided between the buffer zone and the take-up roller 2 for temporarily holding the web. Printing may then continue uninterrupted since the output web is guided into the buffer zone, while the leading edge L may be held in place for performing one or more of the steps according to the present invention.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The invention claimed is:

1. A web winding device for attaching a leading edge of a web output by a printing system to a take-up roller, comprising:

a transport path for the web;

a take-up roller rotatable around a roller axis positioned at an end of the transport path; and a guide device rotatable with respect to the roller axis from a first angular position to a second angular position;

wherein:

the first angular position is positioned adjacent the end of the transport path and the second angular position is positioned in a space between the transport path and the take-up roller, and the guide device is arranged for:

when at the first angular position, pushing the leading edge of the web against the take-up roller, during rotation of the guide device, holding the leading edge in pushing engagement with the take-up roller, and when at the second angular position, guiding the leading edge between the web on the transport path and the take-up roller for attaching the leading edge to the take-up roller.

2. The web winding device according to claim 1, wherein the first angular position is positioned on one side of a central plane substantially perpendicular to a plane of the transport path, which central plane extends through the roller axis, and wherein the second angular position is positioned on a second side of the central plane.

3. The web winding device according to claim 1, further comprising an angular device for rotating the guide device synchronously with respect to the take-up roller.

4. The web winding device according to claim 3, wherein the angular device comprises a first pivoting arm pivotable with respect to the roller axis, on which first pivoting arm the guide device is mounted.

5. The web winding device according to claim 1, wherein during use, the guide device extends parallel to the roller axis over substantially a width of the web.

6. The web winding device according to claim 1, wherein the guide device further comprises two guide elements, and wherein the guide elements, when in pushing engagement with the leading edge, are angularly spaced apart from one another with respect to the roller axis.

7. The web winding device according to claim 1, further comprising an engagement device for moving the guide device from a remote position spaced apart from the take-up roller to the first angular position for pushing the leading edge against the take-up roller.

8. The web winding device according to claim 1, further comprising a moveable pressing device positioned near the second angular position, wherein the pressing device is arranged for pushing the guide device at the second angular position against the web on the take-up roller.

9. The web winding device according to claim 1, further comprising a pinch roller moveable between a distant position spaced from the take-up roller and a pinch position adjacent the take-up roller, wherein the pinch roller and the take-up roller, when the pinch roller is in the pinch position, are arranged to hold the web between them.

10. The web winding device according to claim 1, further comprising a controller arranged for actuating the web winding device, which controller comprises a sensor device for detecting the leading edge of the web.

11. A printing system comprising a web winding device according to claim 1.

12. A method for winding a web output along a transport path of a printing system on a take-up roller, which take-up roller is rotatable with respect to a roller axis, the method comprising the steps of:

transporting a leading edge of the web from the transport path over a take-up roller;

positioning a guide device in a first angular position with respect to the roller axis, wherein first angular position is positioned adjacent the transport path and wherein in the first angular position, the guide device pushes the leading edge against the take-up roller;

rotating the guide device to a second angular position with respect to the roller axis, which second angular position is positioned in a space between the transport path and the take-up roller;

holding the guide device in pushing engagement with the leading edge as the guide device rotates from the first angular position to the second angular position; and positioning the guide device in the second angular position to guide the leading edge between the web and the take-up roller.

13. The method according to claim 12, wherein the step of positioning the guide device further comprising moving the guide device from a remote position spaced apart from the take-up roller to the first angular position to push the leading edge against the take-up roller.

14. The method according to claim 13, further comprising the steps:

guiding the leading edge between the web on the transport path and the take-up roller; and releasing the guide device from the web.

15. The method according to claim 14, wherein the step of positioning the guide device in the second angular position further comprises pushing the guide device at the second angular position against the web on the take-up roller.

* * * * *